US009442457B2

(12) United States Patent
Maeda et al.

(10) Patent No.: US 9,442,457 B2
(45) Date of Patent: Sep. 13, 2016

(54) IMAGE FORMING APPARATUS WITH REMOVABLE PROCESS UNITS

(71) Applicant: CANON KABUSHIKI KAISHA, Tokyo (JP)

(72) Inventors: Naoki Maeda, Suntou-gun (JP); Noriyuki Komatsu, Numazu (JP); Osamu Anan, Susono (JP); Tetsuya Numata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/719,596

(22) Filed: May 22, 2015

(65) Prior Publication Data

US 2015/0362869 A1 Dec. 17, 2015

(30) Foreign Application Priority Data

Jun. 13, 2014 (JP) ..... 2014-122262

(51) Int. Cl.
*G03G 15/00* (2006.01)
*G03G 21/16* (2006.01)
*G03G 15/16* (2006.01)

(52) U.S. Cl.
CPC ..... *G03G 21/1623* (2013.01); *G03G 15/1605* (2013.01); *G03G 2215/0132* (2013.01); *G03G 2221/169* (2013.01); *G03G 2221/1684* (2013.01)

(58) Field of Classification Search
CPC ..... G03G 21/1842; G03G 21/1839; G03G 21/1807; G03G 21/1817; G03G 21/1803; G03G 21/18; G03G 21/1676; G03G 21/1671; G03G 15/1655
USPC ..... 399/110, 111, 112, 113, 117
See application file for complete search history.

(56) References Cited

U.S. PATENT DOCUMENTS

2003/0053819 A1* 3/2003 Nomura ..... G03G 15/0896 399/110
2012/0328326 A1* 12/2012 Sato ..... G03G 21/1623 399/110

FOREIGN PATENT DOCUMENTS

JP 2009-157135 A 7/2009

* cited by examiner

*Primary Examiner* — Billy Lactaoen
(74) *Attorney, Agent, or Firm* — Fitzpatrick, Cella, Harper & Scinto

(57) ABSTRACT

An image forming apparatus includes a moving member configured to be moved with respect to a main body of the image forming apparatus while supporting an image bearing member and a developer bearing member and configured to move between an inner position in which the moving member is located inside the main body and an outer position in which the moving member is located outside the main body so that the developer bearing member is removable from the moving member; a transfer device provided in the main body opposite to the image bearing member when the moving member is located in the inner position, and configured to transfer a developer image formed on the image bearing member; and a biasing member provided on the moving member and configured to bias the image bearing member toward the transfer device when the moving member is located in the inner position.

16 Claims, 13 Drawing Sheets

IMAGE FORMING APPARATUS WITH REMOVABLE PROCESS UNITS

BACKGROUND OF THE INVENTION

1. Field of the Invention

The present invention relates to an image forming apparatus. More particularly, the present invention relates to an image forming apparatus suited for use as a copying machine, a printer (such as LED printer and laser beam printer), a facsimile machine, a word processor, and the like that are configured to form an image on a recording medium by using an electrophotographic image forming process.

2. Description of the Related Art

Hitherto, in image forming apparatus using an electrophotographic image forming process, there has been known a process cartridge system in which photosensitive drums and developing units each housing a developing roller to affect the corresponding photosensitive drums and each containing developer (toner) to be used for image formation are integrated with each other. Further, there has also been known a developing cartridge system in which the cartridge has only the developing units independently of the photosensitive drums.

Those cartridge systems allow users themselves to perform maintenance of the apparatus without service engineers. Thus, those cartridge systems have been widely used in electrophotographic image forming apparatus.

Further, there has also been known a technology of arranging a moving member to which those cartridges are mounted and being removable by being pulled out from an inside of a main body of the image forming apparatus to a predetermined position so that an operation of replacing the cartridges can be performed. The technology allows users to easily replace cartridges containing the developer (Japanese Patent Application Laid-Open No. 2009-157135).

However, in the image forming apparatus using the above-mentioned related-art moving member to which the cartridges are mounted, a problem of instability of positioning image bearing members with respect to transfer devices in the main body, or a problem of a large mounting load to be applied when the moving member is mounted into the main body has not yet been solved.

In other words, there have been demands to reduce the instability of positioning the image bearing members with respect to the transfer devices in the main body, or to reduce the large mounting load to be applied when the moving member is mounted into the main body.

SUMMARY OF THE INVENTION

According to a representative embodiment, there is disclosed an image forming apparatus, comprising:

a moving member configured to be moved with respect to a main body of the image forming apparatus in a state in which the moving member supports an image bearing member and a developer bearing member, the moving member being configured to move between an inner position in which the moving member is located inside the main body and an outer position in which the moving member is located outside the main body so that the developer bearing member is removable from the moving member;

a transfer device provided in the main body so as to be opposed to the image bearing member when the moving member is located in the inner position, the transfer device being configured to transfer a developer image formed on the image bearing member; and a biasing member provided on the moving member and configured to bias the image bearing member toward the transfer device in a state in which the moving member is located in the inner position.

Further features of the present invention will become apparent from the following description of exemplary embodiments with reference to the attached drawings.

DESCRIPTION OF THE EMBODIMENTS

Now, embodiments of the present invention will be described in detail with reference to the drawings.

(Image Forming Apparatus)

Figure 1:
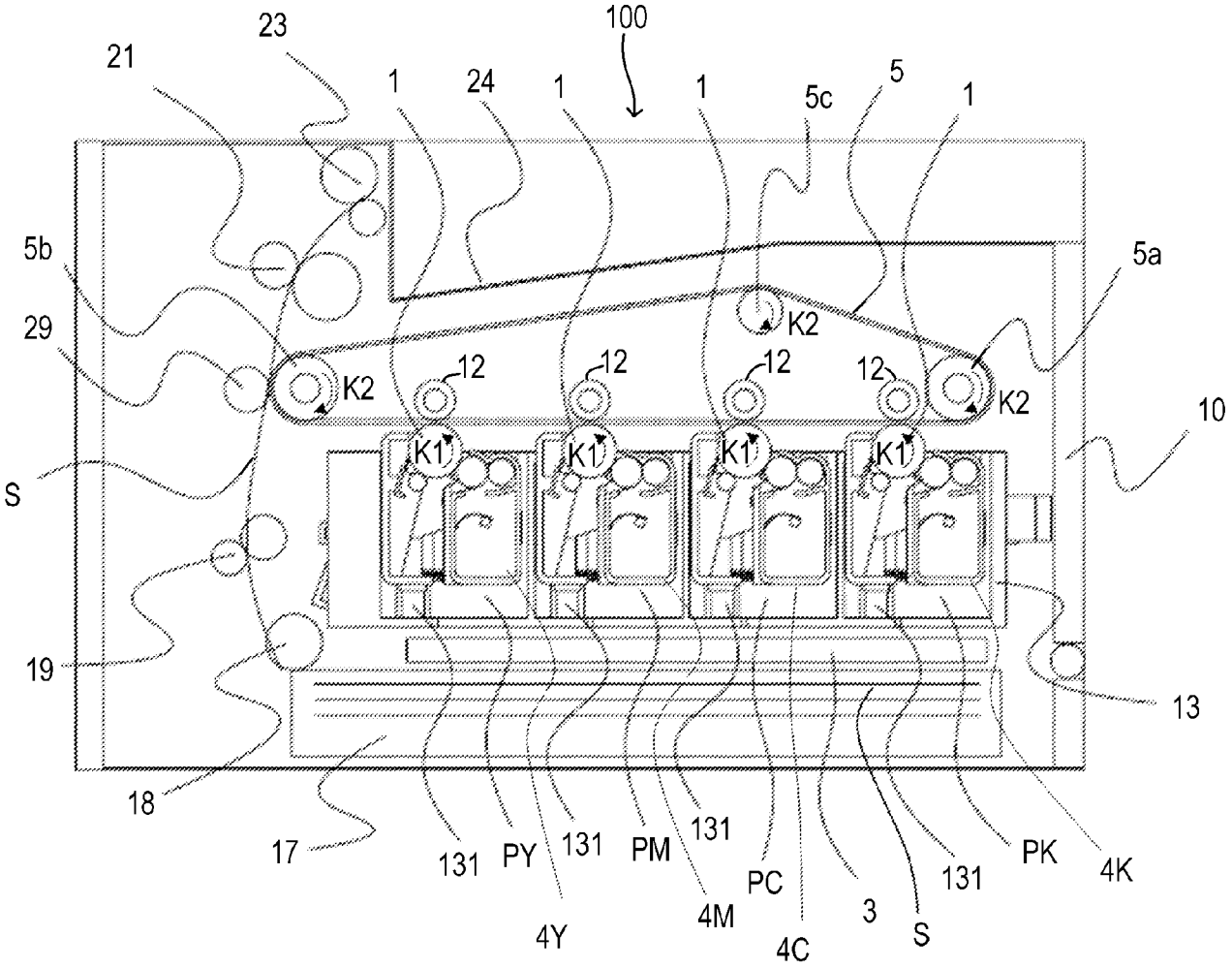
FIG. 1 is a sectional view illustrating an image forming apparatus according to an embodiment at the time of image formation.
Figure 2:
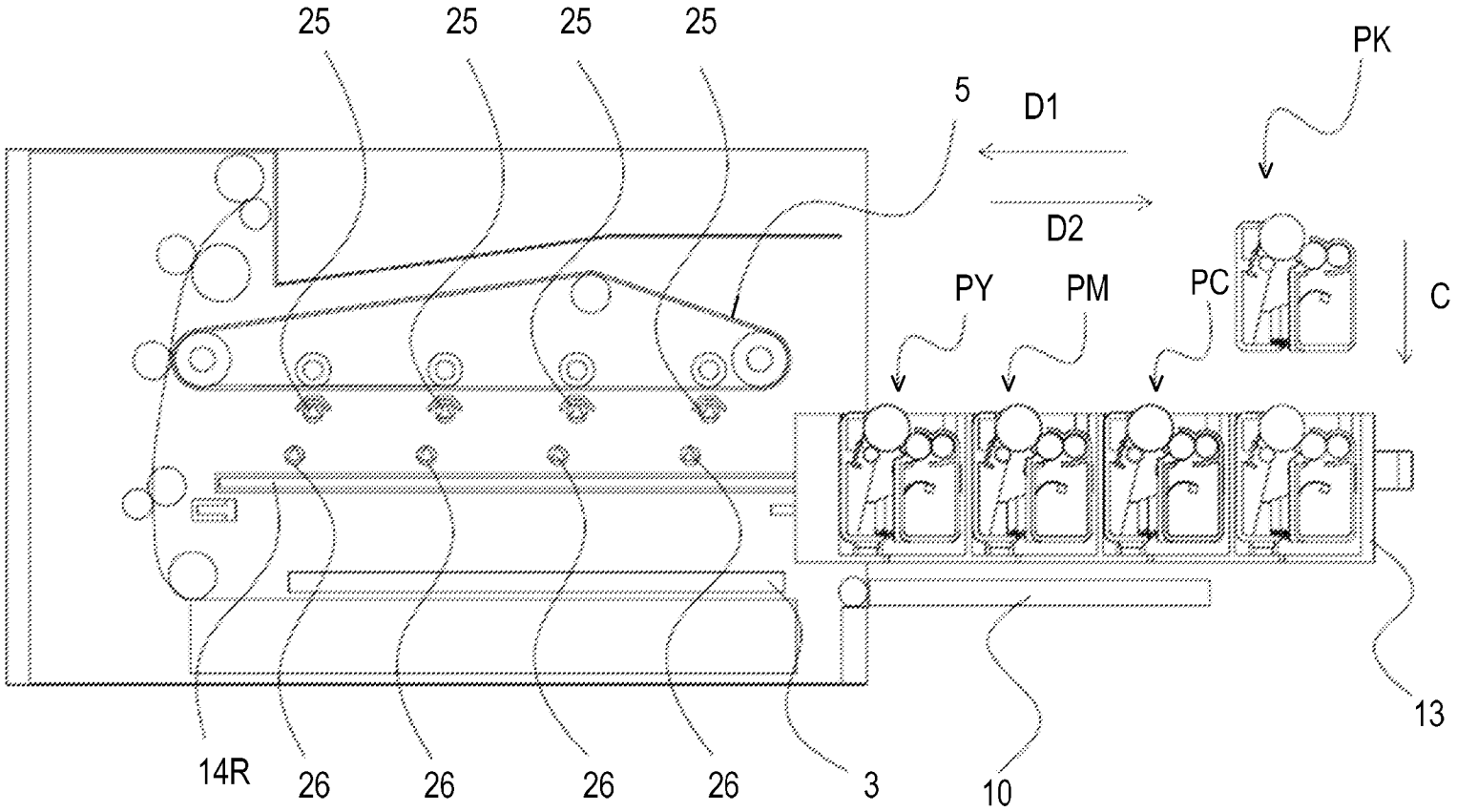
FIG. 2 is a sectional view illustrating how a moving member is mounted into an image forming apparatus main body according to the embodiment.
Figure 8A:
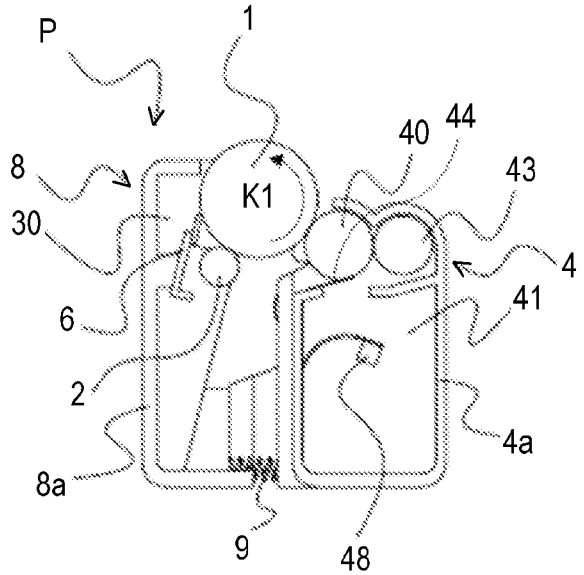
FIG. 8A is a sectional view illustrating a cartridge according to the embodiment.

With reference to FIGS. 1, 2, and 8A, an overall structure of an image forming apparatus according to an embodiment of the present invention will be described. The image forming apparatus 100 according to the embodiment includes four electrophotographic photosensitive members (hereinafter referred to as "photosensitive drums 1") that are arrayed in a horizontal direction. Those photosensitive drums 1 are each rotated in a direction of the arrow K1 (counterclockwise) in FIG. 1 by drive units (not shown).

Further, in the image forming apparatus 100, charging units 2, exposure devices 3 (3Y, 3M, 3C, and 3K (not shown)), developing units 4, and an intermediate transfer belt 5 are arranged as electrophotographic image forming process units in addition to the photosensitive drums 1. Note that, the charging unit 2 has a function to uniformly charge a surface of the photosensitive drum 1. Further, the exposure device 3 is, for example, a laser scanner unit.

The developing unit 4 has a function to develop an electrostatic latent image, which is formed on the surface of the photosensitive drum 1, by using toner as developer. Then, the toner image (developer image) on the photosensitive drum 1 is primarily transferred onto the intermediate transfer belt 5 as a transferred member by corresponding one of primary transfer rollers 12 as transferring members, and then transferred onto a recording medium (sheet material S) as a transferred material by a secondary transfer roller 29. The primary transfer rollers 12, the secondary transfer roller 29, and the intermediate transfer belt 5 serve as a transfer device configured to transfer the developer image. Note that, as specific examples of the sheet material S as a recording medium, there are given a paper sheet, an OHP sheet, and a cloth.

Further, the image forming apparatus 100 includes cleaning members 6 configured to remove toner remaining on the surface of the photosensitive drums 1 after the transfer.

The photosensitive drum 1 is obtained by applying an organic photoconductor layer (OPC photosensitive member) to an outer peripheral surface of an aluminum cylinder. Both end portions of the photosensitive drum 1 are supported in a freely rotatable manner by a moving member (not shown). Thus, a drum coupling (not shown) configured to receive a driving force from a drive motor (not shown) is arranged at one of the end portions. With this, the photosensitive drum 1 receives the driving force from the drive motor through intermediation of the drum coupling, and is thereby rotated.

The charging unit 2 according to the embodiment employs a contact charging type. More specifically, the charging unit 2 is a conductive roller formed into a roller shape, and the charging roller 2 abuts against the surface of the photosensitive drum 1. Then, a charging bias voltage is applied to the charging roller 2 so that the surface of the photosensitive drum 1 is uniformly charged.

The developing units 4 respectively include toner containers 41 (refer to FIG. 8A) that respectively contain toners of yellow, magenta, cyan, and black (hereinafter represented by yellow: Y, magenta: M, cyan: C, and black: K). Note that, those toner containers 41 serve as developer containing portions configured to contain developers (toners) to be supplied to developing rollers 40 as developer bearing members. The toners in those toner containers 41 are supplied to toner supply rollers 43. Then, the toner supply roller 43 and a developing blade 44 that is held in pressure contact with an outer periphery of the developing roller 40 causes the toner to be applied to the outer periphery of the developing roller 40 and to be electrically charged.

Then, a developing bias is applied to the developing roller 40 so that the toner adheres to the latent image formed on the photosensitive drum 1. With this, the toner image (developer image) is formed. Note that, the developing roller 40 is arranged so as to face and come into contact with the photosensitive drum 1. The developing roller 40 serves as the developer bearing member configured to bear the developer so that the latent image is developed. The photosensitive drum 1 serves as an image bearing member on which the latent image is formed, which is configured to bear the image (toner image, that is, developer image).

Note that, the developing unit 4 and the photosensitive drum 1 integrally correspond to a cartridge P (PY, PM, PC, and PK) (hereinafter referred to as "cartridge P"). When the toner is consumed through use by users and the cartridge P reaches its end of life, the cartridge P as a whole can be replaced (what is called a cartridge system).

A full-color image is formed by the following operation. The photosensitive drums 1 of the cartridges P are each driven to rotate at a predetermined control speed in the direction of the arrow K1 in FIG. 1. The charging rollers 2 are driven in conjunction with the photosensitive drums 1. Further, the intermediate transfer belt 5 is driven to rotate in a direction of the arrows K2 (clockwise direction) at a speed in accordance with the speed of the photosensitive drums 1. The intermediate transfer belt 5 is a flexible dielectric endless belt, and is stretched around a driving roller 5*a*, a secondary transfer opposing roller 5*b*, and a tension roller 5*c*.

The endless belt serving as the intermediate transfer belt 5 extends in substantially the same direction as a moving direction of a moving member 13 described below, and extends in an axial direction of the photosensitive drum 1 (the axial direction of the photosensitive drum 1 is hereinafter referred to as "longitudinal direction").

Further, the developing roller 40 (refer to FIG. 8A) and the toner supply roller 43 are each driven to rotate at a predetermined control speed. In synchronization with the driving, in each of the cartridges P, a predetermined charging bias is applied to the charging roller 2 at a predetermined control timing. With this, the surface of the photosensitive drum 1 is uniformly charged with a predetermined polarity and electric potential by the charging roller 2. The exposure devices 3 expose the surfaces of the photosensitive drums 1 in the cartridges P with information light beams in accordance with image signals of Y, M, C, and K.

With this, the electrostatic latent images of the image signals of corresponding colors are formed on the surfaces of the photosensitive drums 1 of the cartridges P. Then, in each of the cartridges P, the electrostatic latent image formed on the surface of the photosensitive drum 1 is developed into the developer image by the developing roller 40. In each of the cartridges P, a predetermined developing bias is applied at a predetermined control timing to the developing roller 40. Through the electrophotographic image forming process operation as described above, a Y-color developer image corresponding to a Y-color component of the full-color image is formed on the photosensitive drum 1 of the cartridge PY.

Then, the developer image is primarily transferred onto the intermediate transfer belt 5 at the primary-transfer nip portion. The primary transfer roller 12 as a transferring member is in pressure contact with the photosensitive drum 1 through the intermediate transfer belt 5 to form the primary-transfer nip portion.

A primary transfer bias having a polarity reverse to a charging polarity of the developer and having a predetermined electric potential is applied to each of the primary transfer rollers 12 at a predetermined control timing. With this, developer images of the four colors are sequentially superimposed onto a surface of the intermediate transfer belt 5 while the intermediate transfer belt 5 is nipped and conveyed through the primary-transfer nip portions.

Subsequently, in the same way, an M-color developer image from the cartridge PM, a C-color developer image from the cartridge PC, and a K-color developer image from the cartridge PK are primarily transferred onto the intermediate transfer belt 5 through intermediation of the photosensitive drums 1.

In this way, on the intermediate transfer belt 5, a four-full-color unfixed developer image is formed by combining the color Y, the color M, the color C, and the color K. Note that, the developer images of those colors need not necessarily be superimposed and transferred sequentially onto the intermediate transfer belt 5 in the order described above. In each of the cartridges P, untransferred residual developer remaining on the drum surface after the primary transfer is removed by a blade (cleaning member 6), and collected into a waste toner container 30 (refer to FIG. 8A).

Meanwhile, a feed roller 18 is driven at predetermined control timings. With this, the sheet-like recording media S (transferred materials) received and stacked in a sheet feeding cassette 17 are fed. Then, at a predetermined control timing, the recording medium S is introduced by a registration roller pair 19 into a secondary-transfer nip portion as an abutment portion between the intermediate transfer belt 5 and the secondary transfer roller 29.

A secondary transfer bias having a polarity reverse to the charging polarity of the developer and having a predetermined electric potential is applied to the secondary transfer roller 29 at a predetermined control timing. With this, the four-color-superimposed developer image on the intermediate transfer belt 5 is secondarily transferred onto a surface of the recording medium S while the recording medium S is nipped and conveyed through the secondary-transfer nip portion. The recording medium S, which passes through the secondary-transfer nip portion, is separated from the surface of the intermediate transfer belt 5 and is introduced into a fixing device 21. Then, the recording medium S is heated and pressurized in a fixing nip portion. With this, the above-mentioned colors of the developer images are mixed with each other, and the developer images are fixed onto the recording medium S. Then, the recording medium S is fed out from the fixing device 21, and delivered as a full-color image product by a delivery roller pair 23 onto a delivery tray 24.

Note that, in the embodiment, the secondary transfer roller 29 is brought into abutment against the intermediate transfer belt 5 by a shift mechanism (not shown) to be movable to both a formation position at which the secondary-transfer nip portion is formed, and a non-formation position at which the secondary transfer roller is separated from and kept out of contact with the intermediate transfer belt 5. In this way, the secondary transfer roller 29 is moved to the formation position at the time of an image forming operation of the image forming apparatus 100, and moved to the non-formation position at the time of non-image formation. Note that, the secondary transfer roller 29 may be configured to be always held in abutment against the intermediate transfer belt 5.

Further, in the configuration of the embodiment, the intermediate transfer belt 5 is arranged above the photosensitive drums 1, and the exposure devices 3 are arranged below the photosensitive drums 1. Thus, immediately after the formation of the unfixed developer image of the color Y, the color M, the color C, and the color K on the intermediate transfer belt 5, the unfixed developer image can be transferred onto the recording medium S through intermediation of the secondary transfer roller 29. In this way, there is provided an advantage that a first printed material can be quickly output.

(Moving Member)

Next, the moving member 13 as a moving member that is movable between an inside position in the inside of the main body (inner position) and an outside position on an outside of the main body (outer position) while supporting the cartridges P will be described. Note that, the main body excludes, of the various members (components) of the image forming apparatus, at least the moving member, and other members (components) that are configured to be fixed to or freely mounted into and removed from this moving member. The main body will be described in detail below.

As illustrated in FIG. 2, the moving member 13 can be linearly moved with respect to (pushed into or pulled out from) the main body substantially in the horizontal direction (directions of the arrows D1 and D2). With this, the moving member 13 can be moved to the inside position in the inside of the main body (position illustrated in FIG. 1), or to the outside position at which the moving member is pulled out to the outside of the main body (position illustrated in FIG. 2).

Then, when the moving member 13 is located at the outside position, the photosensitive drums 1 and the developing rollers 40 can be mounted into and removed from the moving member 13. In other words, when the moving member 13 is located at the outside position, the cartridges P (PY, PM, PC, and PK) each including the photosensitive drum 1 and the developing roller 40 are mounted into and removed from the moving member 13 substantially in a gravity direction (direction of the arrow C in FIG. 2) by a user. The cartridges P that have been mounted into the moving member 13 are arranged so that longitudinal directions thereof (axial directions of the photosensitive drums 1) are orthogonal to the moving direction of the moving member 13. Note that, the four cartridges PY, PM, PC, and PK are arrayed in the moving direction of the moving member 13. Those cartridges P are moved into the main body together with the moving member 13 in the state of being mounted into the moving member 13.

In this way, in the image forming apparatus 100 according to the embodiment, the four cartridges P can be collectively mounted into the main body, and the four cartridges P can be collectively pulled out to the outside of the main body. Thus, operability at the time of replacement of the cartridges P is more excellent than that in a case where a configuration of independently mounting the cartridges into the main body is employed. Note that, the moving member 13 having the cartridges P mounted thereinto is hereinafter referred to as a moving member unit U1.

(Main Body)

Figure 3A:
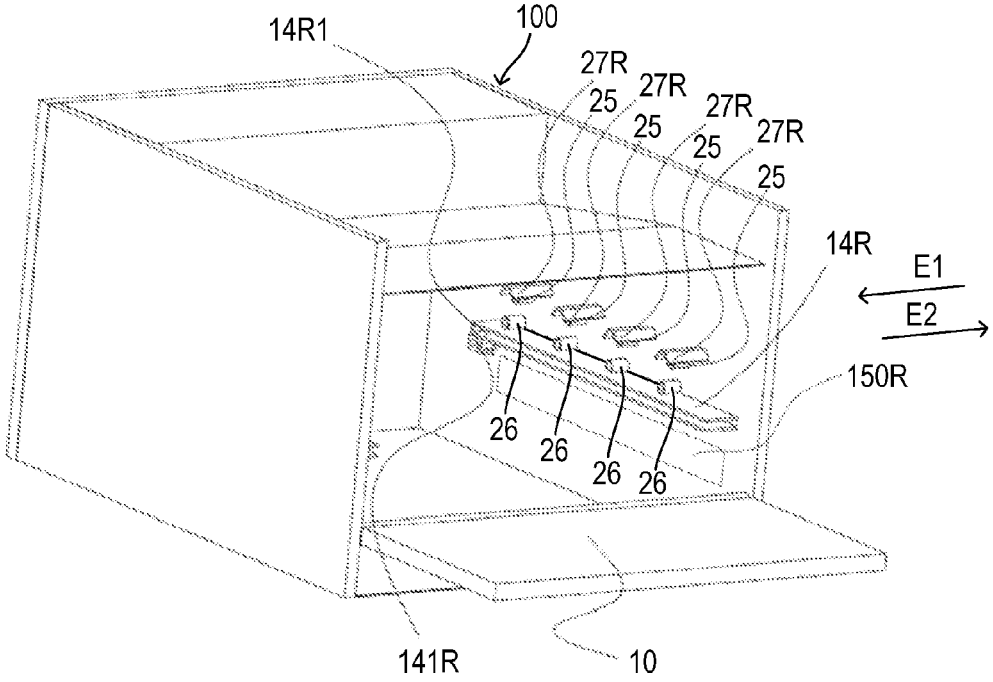
FIG. 3A is a perspective view illustrating a moving member mounting portion in the image forming apparatus main body on a drive side according to the embodiment.
Figure 3B:
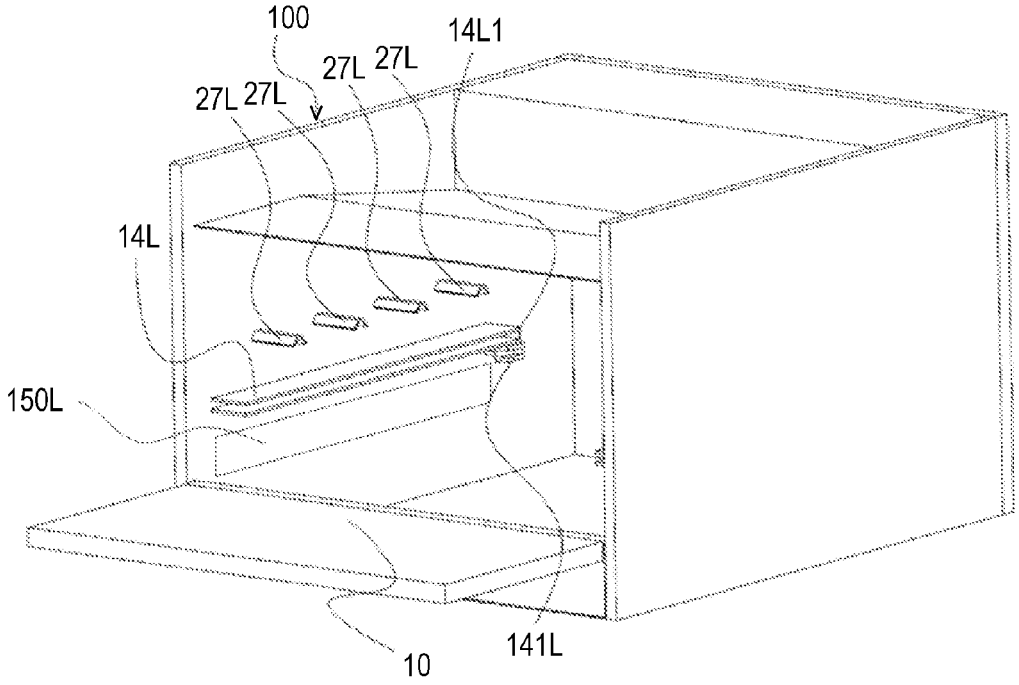
FIG. 3B is a perspective view of the moving member mounting portion in the image forming apparatus main body on a non-drive side according to the embodiment.

Next, with reference to FIGS. 3A and 3B, a configuration of a mounting portion of the moving member 13 in the main body will be described. FIGS. 3A and 3B are each a perspective view illustrating the mounting portion of the moving member 13 in the main body of the image forming apparatus according to the embodiment. Note that, in FIGS. 3A and 3B, for ease of understanding of the configuration of the mounting portion, of the members (components) of the main body, the intermediate transfer belt 5 and other members are not illustrated. Further, the perspective views of FIGS. 3A and 3B are different in viewing direction from each other.

As illustrated in FIGS. 3A and 3B, on an inner wall surface of a frame of the main body, drum coupling members 25 each configured to receive a driving force from a drive source and to transmit the drive to the photosensitive drum 1, and positioning portions 27 to be used for positioning of the cartridges P with respect to the main body are arranged at equal intervals in the horizontal direction. The positioning portions 27 include positioning portions 27R and 27L which are provided on a right-hand side and a left-hand side, respectively, as viewed from a side on which a door 10 is opened so that the positioning portions 27R and 27L are provided opposite to each other. Now, the suffixes "R" and "L" are added to represent components that are arranged respectively on a drive side and a non-drive side and face each other.

Note that, the drum coupling members 25 are configured to retreat to a direction indicated by the arrow E2 in the longitudinal direction when the door 10 is opened, and are configured to move to a direction indicated by the arrow E1 in conjunction with an operation of closing the door 10 to enter the side of the cartridge P.

Further, below the drum coupling members 25, development coupling members 26 are similarly arranged at equal intervals in the horizontal direction. As well as the drum coupling members 25, the development coupling members 26 are each configured to receive a driving force from a drive source (not shown), to transmit the drive to the developing roller 40 as the developer bearing member, and to enter and retreat in the directions of the arrows E1 and E2 in conjunction with opening and closing of the door 10.

Figure 5A:
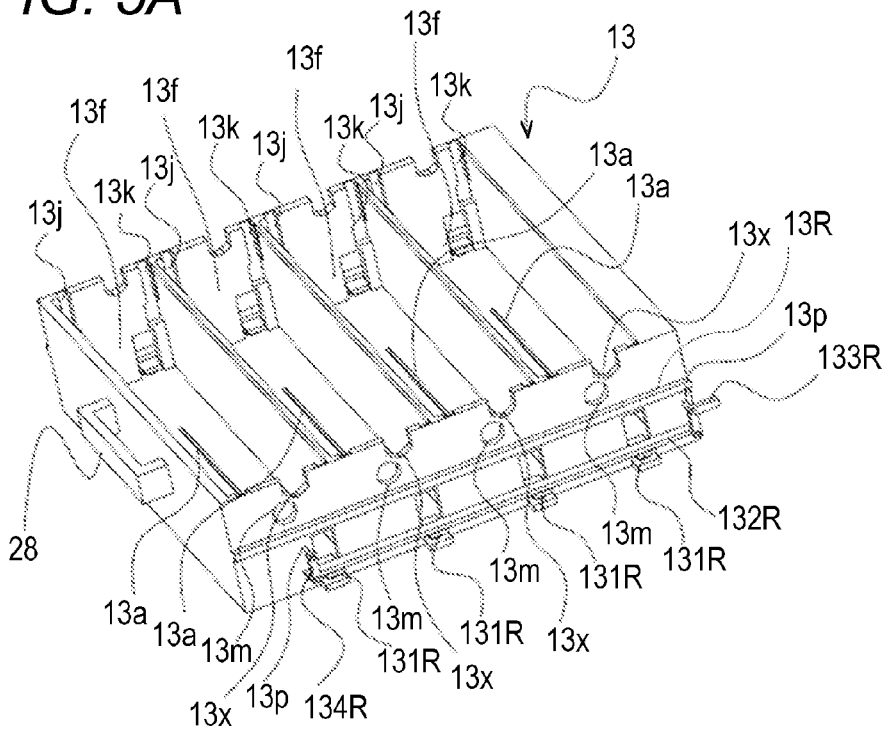
FIG. 5A is a perspective view illustrating the moving member on the drive side according to the embodiment.
Figure 5B:
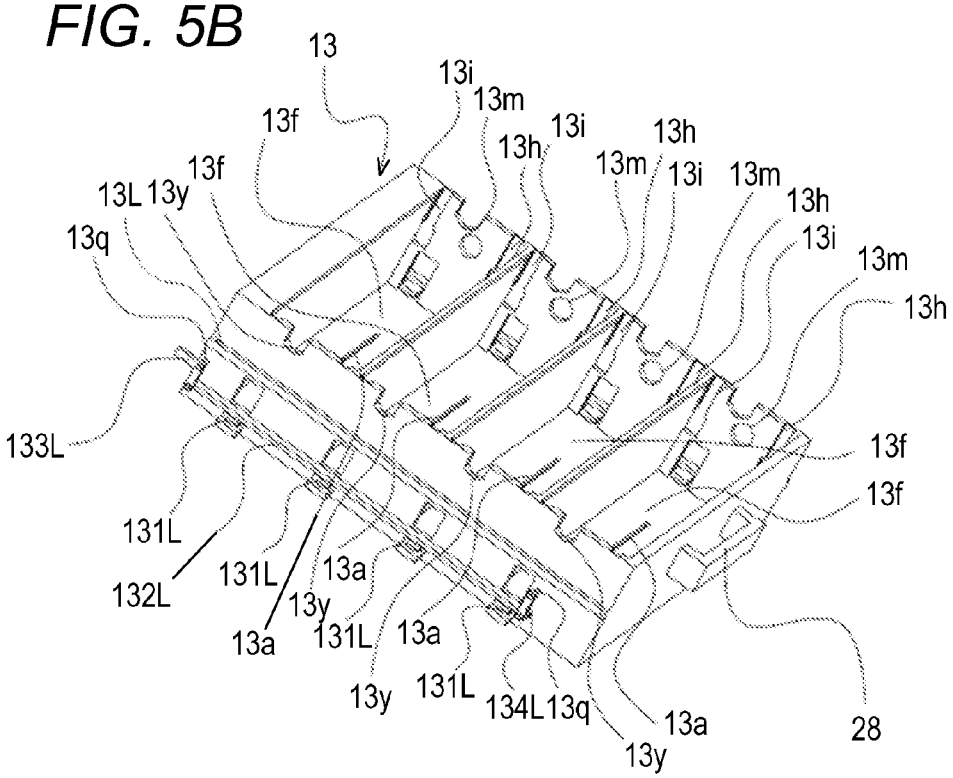
FIG. 5B is a perspective view illustrating the moving member on the non-drive side according to the embodiment.

Further, a pair of guiding portions 14R and 14L configured to guide the moving member 13 along its moving direction are arranged on the inner wall surface of the frame of the main body. Those guiding portions 14R and 14L are each formed into a C-shape in cross-section so that guided portions 13R and 13L of the moving member 13, which are illustrated in FIGS. 5A and 5B, are guided.

Further, as illustrated in FIGS. 3A and 3B, on the inner wall surface of the frame of the main body, switching members 141R and 141L configured to switch contact and separation of the photosensitive drum 1 and the intermediate transfer belt 5 (to switch actuation and release of the actuation of regulating members configured to regulate biasing forces of biasing members described below) are arranged below the guiding portions 14R and 14L. Further, actuating members 150R and 150L configured to displace (turn) the switching members 141R and 141L are arranged as well.

Note that, the switching members 141R and 141L and the actuating members 150R and 150L, which are arranged in the main body, function as a drive mechanism configured to change a state of regulation performed by the regulating member into a state of releasing the regulation at the inner position of the moving member 13. Then, as described below, in conjunction with the opening and closing of the door 10 arranged on the main body, this drive mechanism is engaged with cam members 133 arranged on the moving member 13, to thereby move (displace) regulating members 132 engaged with the cam members 133 in conjunction therewith.

Figure 4A:
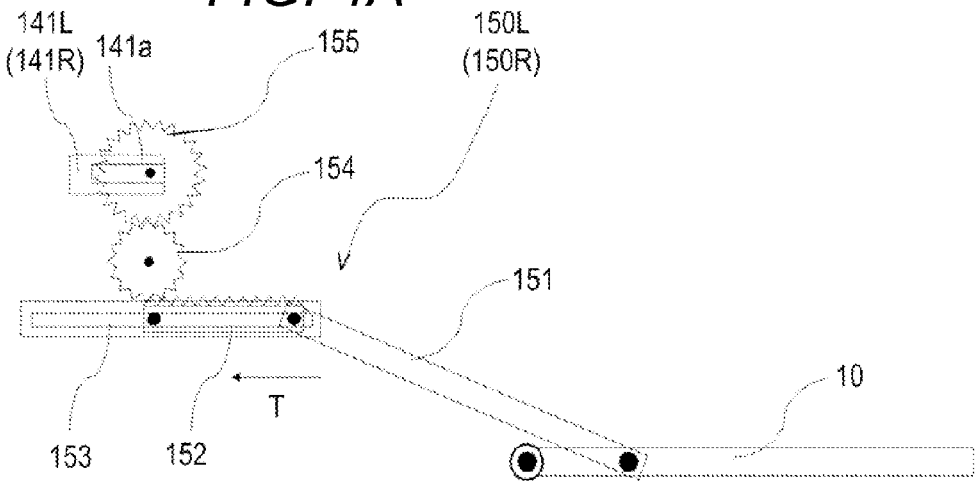
FIG. 4A is a schematic view illustrating an actuating mechanism for a door according to the embodiment and a switching member when the door is opened.
Figure 4B:
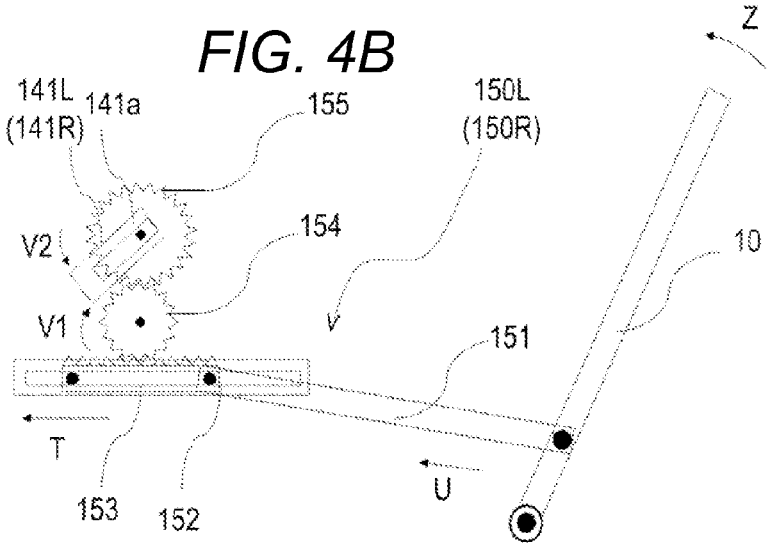
FIG. 4B is a schematic view illustrating the actuating mechanism for the door according to the embodiment and the switching member when the door is closed up to the middle.
Figure 4C:
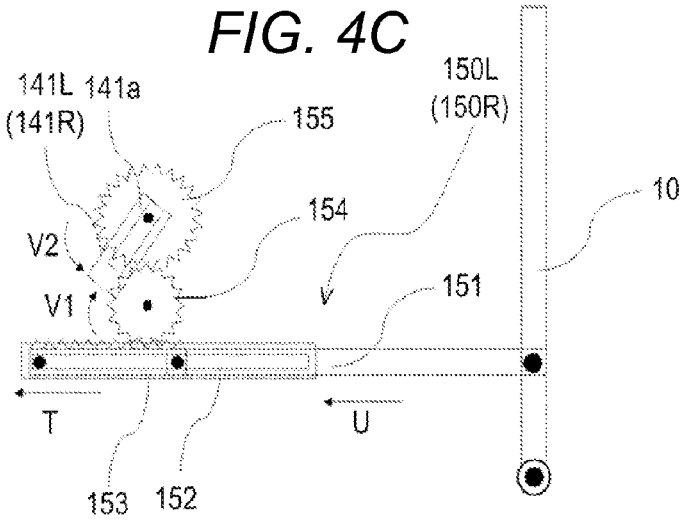
FIG. 4C is a schematic view illustrating the actuating mechanism for the door according to the embodiment and the switching member when the door is closed.

FIG. 4A is an explanatory view illustrating the switching member 141L and the actuating member 150L when the door 10 is opened. Further, FIG. 4B is an explanatory view illustrating the switching member 141L and the actuating member 150L when the door 10 is closed up to the middle. FIG. 4C is an explanatory view illustrating the switching member 141L and the actuating member 150L when the door 10 is fully closed. The configuration on the drive side (R), which is not described below, is the same as that on the non-drive side (L).

As illustrated in FIG. 4A, the actuating member 150L includes a link 151, a rack 152 including a gear arranged on its one side, a rack guide 153, a gear 154, and a drive gear 155. One end of the link 151 is supported to be turnable with respect to the door 10 (refer to FIG. 2) of the main body, and another end thereof is supported to be turnable with respect to the rack 152. Further, the rack 152 is moved along the rack guide 153 in a direction of the arrow T in FIG. 4A.

The gear 154 is rotatably supported in the main body, and meshes with the rack 152. Similarly, the drive gear 155 is rotatably supported in the main body, and meshes with the gear 154. Further, the drive gear 155 is turned integrally with the switching member 141L.

The switching member 141L and the actuating member 150L arranged in the main body are operated as follows. As illustrated in FIG. 4B, when the door 10 arranged on the main body is closed in a direction of the arrow Z, the link 151 is moved in a direction of the arrow U. In conjunction therewith, the rack 152 is moved in the direction of the arrow T, and the gear is turned in a direction of the arrow V1. With this, the switching member 141L is turned in a direction of the arrow V2 together with the drive gear 155. Then, when the door 10 is fully closed, the switching member 141L is turned to the position illustrated in FIG. 4C.

Figure 6A:
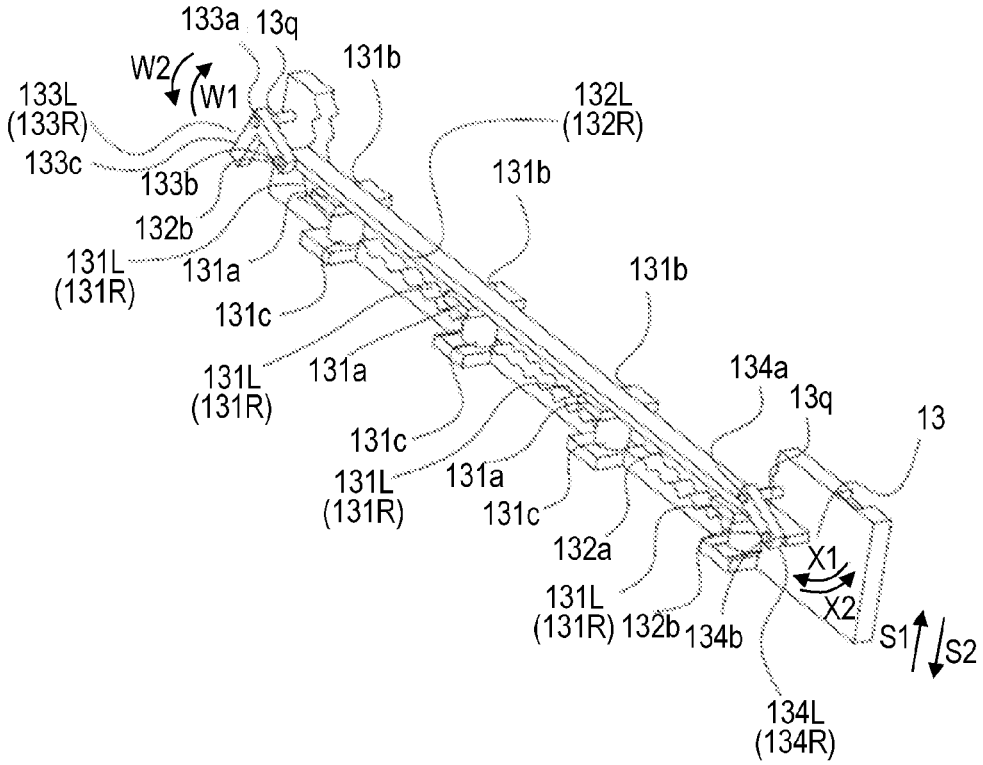
FIG. 6A is a detailed view illustrating a first position of a regulating member according to the embodiment.
Figure 6B:
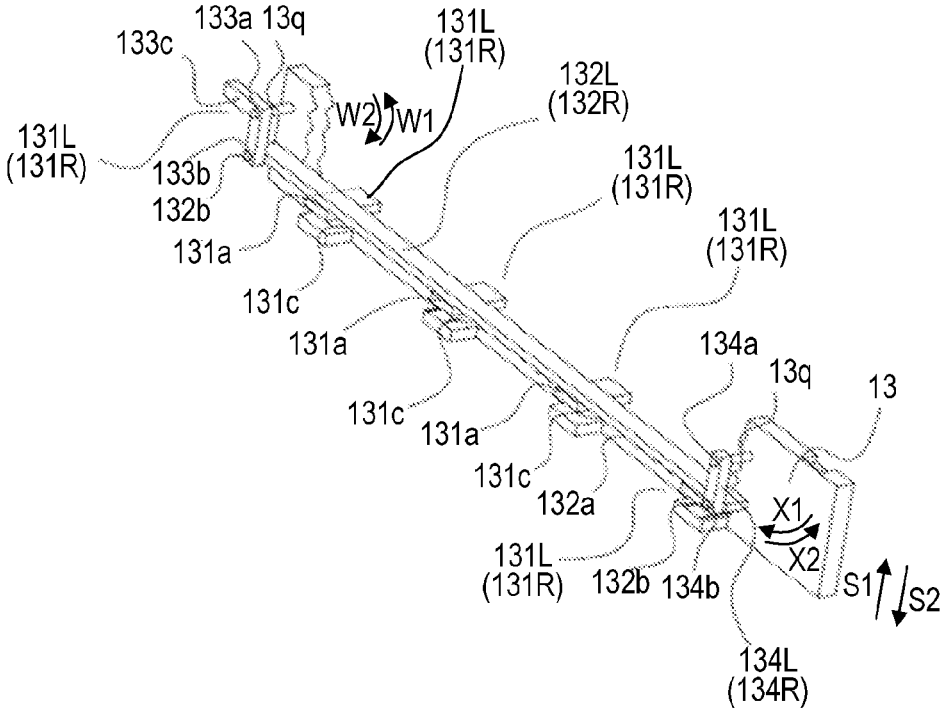
FIG. 6B is a detailed view illustrating a second position of the regulating member according to the embodiment.

The switching member 141L, which is arranged in the main body and interlocks with the opening and closing of the door 10 in this way, includes a mating cam portion 141*a* (FIG. 4A). The mating cam portion 141*a* is engaged with a switching portion 133*c* of the moving member 13 through intermediation of a rotary shaft 13*q* of the moving member 13 (FIGS. 4C and 6B). How the mating cam portion 141*a* (drive side) arranged in the main body and the switching portion 133*c* (driven side) arranged on the moving member 13 are engaged with each other will be described in detail below.

(Details of Moving Member and Relationship between Moving Member and Main Body)

Next, with reference to FIGS. 5A, 5B, 6A, 6B, 7A, and 7B, the moving member 13 will be described in detail. FIG. 5A is a perspective view illustrating the moving member 13 in the image forming apparatus according to the embodiment, and FIG. 5B is a perspective view illustrating the moving member 13 as viewed from the side opposite to that in FIG. 5A. Further, FIG. 6A is a detailed view illustrating a first position of a regulating member 132L (at which the biasing members described below are actuated), and FIG. 6B is a detailed view illustrating a second position of a regulating member 132L (at which action of the biasing members described below is released).

Figure 7A:
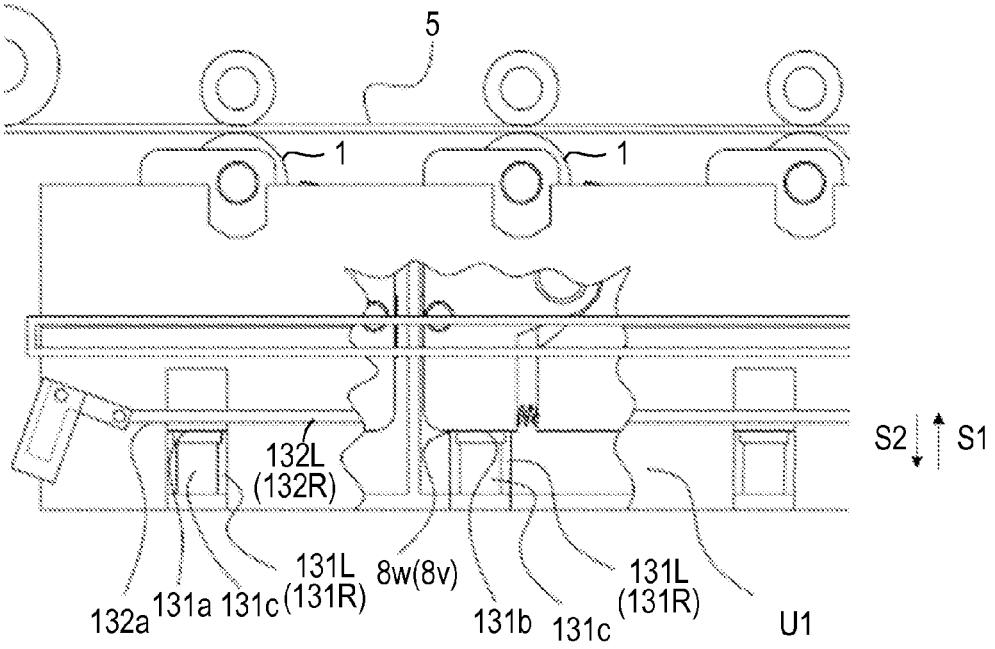
FIG. 7A is a schematic view illustrating an abutting positional relationship between transferring members and photosensitive drums according to the embodiment.
Figure 7B:
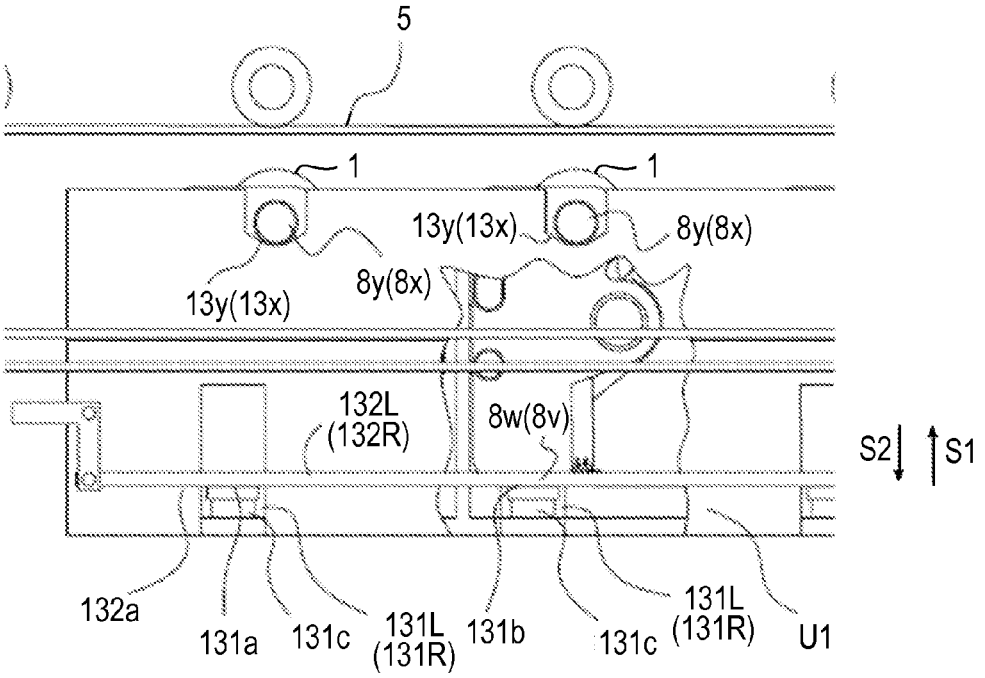
FIG. 7B is a schematic view illustrating a separated positional relationship between the transferring members and the photosensitive drums according to the embodiment.

Further, FIG. 7A is a schematic view illustrating a relationship between biasing members 131L and the regulating member 132L when the photosensitive drums 1 as the image bearing members and the intermediate transfer belt 5 are held in abutment against each other (at abutting position) in the embodiment. Meanwhile, FIG. 7B is a schematic view illustrating a relationship between the biasing members 131L and the regulating member 132L when the photosensitive drums 1 are separated from the intermediate transfer belt 5 (at distant position) in the embodiment. The configuration on the drive side (R), which is not described below, is the same as that on the non-drive side (L).

As illustrated in FIG. 5A, the above-mentioned guided portions 13R and 13L are arranged on the moving member 13. The guided portions 13R and 13L are each formed to project outward from side surface sides, and configured to extend along the moving direction of the moving member so that the moving member 13 is not inclined from a position of the moving member. Further, a grip portion 28 to be operated by a user is arranged on one end portion of the moving member 13.

In addition, mounting portions 13*f* configured to allow the cartridge P described below to be mounted thereinto are formed in an array in the moving member 13. Laser scanner opening portions 13*a* configured to pass information light beams from the exposure devices 3 onto the photosensitive drums 1 are formed through lower portions of the moving member 13. Holding portions 13*x* and 13*y* are formed at both ends in the longitudinal direction of each of the mounting portions 13*f*. Further, development coupling opening portions 13*m* are formed at parts facing the above-mentioned development coupling members 26 of the main body.

Further, on an inside of the moving member 13, guiding portions 13*h*, 13*i*, 13*j*, and 13*k* configured to allow the cartridges P to be mounted are formed. The guiding portions each extend in a vertical direction. In addition, the biasing members 131R and 131L are arranged below the guiding portions 13*h*, 13*i*, 13*j*, and 13*k*. Note that, on outsides of the moving member 13 (both side end portions in a direction intersecting with the moving direction thereof), the regulating members 132R and 132L each formed to be elongated in the moving direction of the moving member 13, first cam members 133R and 133L, and second cam members 134R and 134L are arranged.

As illustrated in FIG. 6A, the biasing members 131L each include a regulated portion 131*a* as a region located on a side opposite to the moving member 13 with respect to the regulating member 132L and facing the regulating member 132L. Further, the biasing members 131L each include a pressing portion 131*b* that does not face the regulating member 132L but faces a photosensitive unit 8 as an image bearing unit, and an elastic portion 131*c* that has a biasing force. Note that, in a case where the moving member 13 includes the image bearing units and the developing units in different pairs for respective colors, a plurality of such biasing members are arranged correspondingly to those pairs.

Further, as illustrated in FIG. 6A, the regulating member 132L has a regulating surface 132*a*, and two shafts 132*b* arranged on both sides. Still further, the first cam member 133L has a support hole 133*a*, a rotary hole 133*b*, and the switching portion 133*c*. The second cam member 134L has a support hole 134*a* and a rotary hole 134*b*.

Further, the support hole 133*a* of the first cam member 133L is engaged with the rotary shaft 13*q* of the moving member 13, and the rotary hole 133*b* thereof is engaged with the shaft 132*b* of the regulating member 132L. Similarly, the support hole 134*a* of the second cam member 134L is engaged with another rotary shaft 13*q* of the moving member 13, and the rotary hole 134*b* thereof is engaged with the shaft 132*b* of the regulating member 132L.

With this configuration, the first cam member 133L and the second cam member 134L are turnable about the corresponding rotary shafts 13*q* of the moving member 13 respectively in directions of the arrows W1 and W2 and in directions of the arrows X1 and X2. When the first cam member 133L and the second cam member 134L are turned, the regulating member 132L can be moved in directions of the arrows S1 and S2 with the regulating member 132L being kept in parallel with a horizontal plane.

When the first cam member 133L is located at the position illustrated in FIG. 6A, the regulating member 132L has been moved in the direction of the arrow S1. Now, this state is referred to as a first position. Meanwhile, when the first cam member 133L is located at the position illustrated in FIG. 6B, the regulating member 132L has been moved in the direction of the arrow S2 to push down the biasing members 131L. With this, the biasing forces of the biasing members 131L are regulated. Now, this state is referred to as a second position.

Figure 8B:
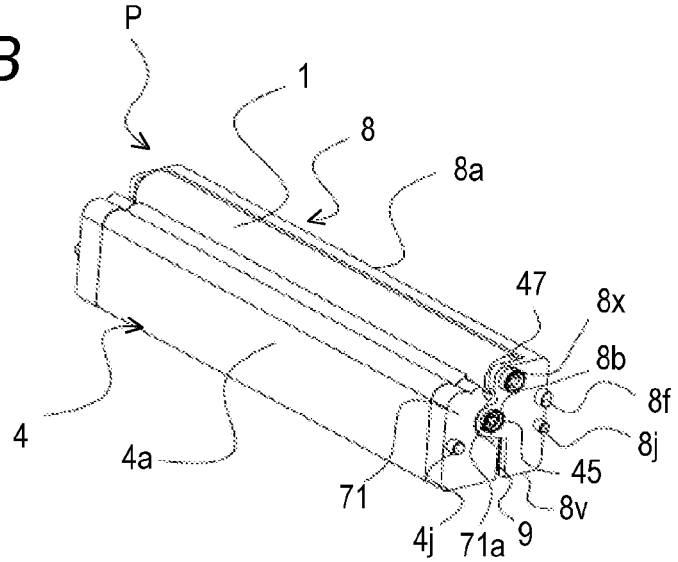
FIG. 8B is a perspective view illustrating the cartridge on the drive side according to the embodiment.
Figure 8C:
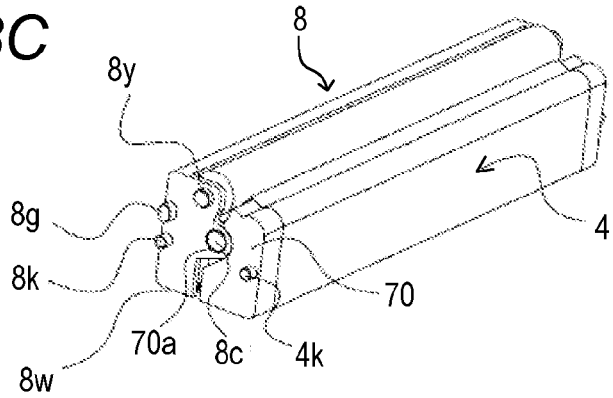
FIG. 8C is a perspective view illustrating the cartridge on the non-drive side according to the embodiment.

Next, movement of the regulating member 132L in the main body will be described. When the regulating member 132L is located at the first position, as illustrated in FIG. 7A, a pressed portion 8*w* (pressed portion 8*v* on the drive side) of the cartridge P, which will be described below with reference to FIGS. 8B and 8C, is pressed by corresponding one of the pressing portions 131*b* (FIG. 6A) of the biasing member 131L. Thus, the force of corresponding one of the elastic portions 131*c* causes the cartridge P including the photosensitive unit 8, which includes the photosensitive drum 1, and the developing unit 4 to be moved in the direction of the arrow S1 with respect to the moving member 13 (upward in the vertical direction). With this, the photosensitive drums 1 abut against the intermediate transfer belt 5.

When the regulating member 132L is located at the second position, as illustrated in FIG. 7B, the biasing forces of the biasing members 131L are regulated by the regulating member 132L. Thus, positioned portions 8*x* and 8*y* of the cartridge P are held by the holding portions 13*x* and 13*y* of the moving member 13. With this, the moving member 13 is inserted into the main body when the photosensitive drums 1 are located at positions retreated from the intermediate transfer belt 5.

(Cartridge)

Next, with reference to FIGS. 8A to 8C, the cartridge P to be mounted into the moving member 13 will be described. FIG. 8A is a schematic sectional view illustrating the cartridge P according to the embodiment, FIG. 8B is a perspective view illustrating the cartridge P according to the embodiment, and FIG. 8C is a perspective view illustrating the cartridge P as viewed from the side opposite to that in FIG. 8B.

As illustrated in FIG. 8A, the cartridge P includes the photosensitive unit 8 as the image bearing unit, and the developing unit 4. Further, the photosensitive unit 8 includes the photosensitive drum 1 as the image bearing member, a photosensitive frame 8*a* configured to support the photosensitive drum 1, the charging unit 2, the cleaning member 6, and the waste toner container 30 configured to collect the toner removed by the cleaning member 6.

Further, the developing unit 4 includes the developing roller 40 as the developer bearing member, a developing frame 4*a* configured to support the developing roller 40, the toner supply roller 43, the developing blade 44, and the toner container 41 configured to contain the toner to be used for image formation. Further, the developing unit 4 also includes a conveying member 48 configured to supply the toner in the toner container 41.

In this configuration, the toner in the toner container 41 is supplied to the toner supply roller 43 by the conveying member 48. Then, the toner supply roller 43 and the developing blade 44 that is held in pressure contact with the outer periphery of the developing roller 40 cause the toner to be applied to the outer periphery of the developing roller 40 and to be electrically charged.

Then, a developing bias is applied from the main body to the developing roller 40 so that the toner adheres to the latent image formed on the photosensitive drum 1 that is rotated in the direction of the arrow K1. With this, the toner image (developer image) is formed. After the toner image borne on the photosensitive drum 1 is transferred onto the sheet material S, toner remaining on the surface of the photosensitive drum 1 is removed by the cleaning member 6, and collected into the waste toner container 30. Note that, in a case where the toner in the toner container 41 is consumed, the user only has to replace the cartridge P to perform printing again.

As illustrated in FIG. 8B, the positioned portions 8*x* and 8*y* are arranged at both ends of the cartridge P. The positioned portions 8*x* and 8*y* abut against the positioning portions 27R and 27L (FIGS. 3A and 3B) of the main body at the time of the above-mentioned image formation. Further, at one end portion of the cartridge P, a first coupling member 47 configured to receive the driving force through intermediation of the drum coupling member 25 on the main body side is supported to be rotatable. In addition, a second coupling member 45 configured to receive the driving force through intermediation of the development coupling member 26 is also supported to be rotatable.

The first coupling member 47 is arranged at the one end of the photosensitive drum 1 to receive the driving force from the main body for rotating the photosensitive drum 1. Further, the driving force received by the second coupling member 45 is transmitted to the developing roller 40, the toner supply roller 43, and the conveying member 48 through intermediation of an intermediate gear (not shown) to rotate those components.

An outer periphery of the second coupling member is covered with a cylindrical rib. With this, an engagement portion 71*a* is formed on a side cover 71 fixed to an outside of the toner container 41. The second coupling member 45 is configured to be turnable about the engagement portion 71*a*. Further, as illustrated in FIG. 8C, an engagement portion 70*a* is formed also on a side opposite to the engagement portion 71*a*. This engagement portion 70*a* is similarly formed on a side cover 70. Those engagement portions 71*a* and 70*a* are formed in the developing unit 4.

Further, hole portions 8*b* and 8*c* configured to support the engagement portions 71*a* and 70*a* are formed through the photosensitive frame 8*a*. The hole portions 8*b* and 8*c* formed through the photosensitive frame 8*a* are engaged with the engagement portions 71*a* and 70*a* arranged on the developing unit 4. With this, the photosensitive unit 8 and the developing unit 4 are coupled to each other.

Specifically, the engagement portions 71*a* and 70*a* are configured to be movable (turnable) respectively about the hole portions 8*b* and 8*c*, and hence the developing unit 4 can be moved with respect to the photosensitive unit 8. In other words, the developing roller 40 is configured to be movable with respect to the photosensitive drum 1. As illustrated in FIGS. 8A to 8C, a spring 9 as a unit biasing member is interposed between the photosensitive unit 8 and the developing unit 4. This spring 9 generates a predetermined pressure for pressing the developing roller 40 against the photosensitive drum 1.

As illustrated in FIG. 8B, a rotation regulated portion 8*f* is arranged below the positioned portion 8*x*. As illustrated in FIG. 8C, a rotation regulated portion 8*g* is arranged below the positioned portion 8*y*. The rotation regulated portions 8*f* and 8*g* are each formed into a shape of a substantially rectangular column extending in the same direction as a mounting direction of the cartridge P into the moving member 13.

The rotation regulated portions 8*f* and 8*g* each have a function to position the cartridge P in the moving member 13. Further, circular columnar regulated portions 8*j*, 4*j*, 8*k*, and 4*k* are arranged below the rotation regulated portions 8*f* and 8*g*. The regulated portions 8*j* and 8*k* and the regulated portions 4*j* and 4*k* are arranged respectively on the photosensitive unit 8 and the developing unit 4 to interpose the photosensitive drum 1 therebetween. Positions of the regulated portions 8*j* and 8*k*, and positions of the regulated portions 4*j* and 4*k* are substantially the same as each other in the mounting direction of the cartridge P into the moving member 13.

(Mounting of Cartridge into Moving Member)

Figure 9A:
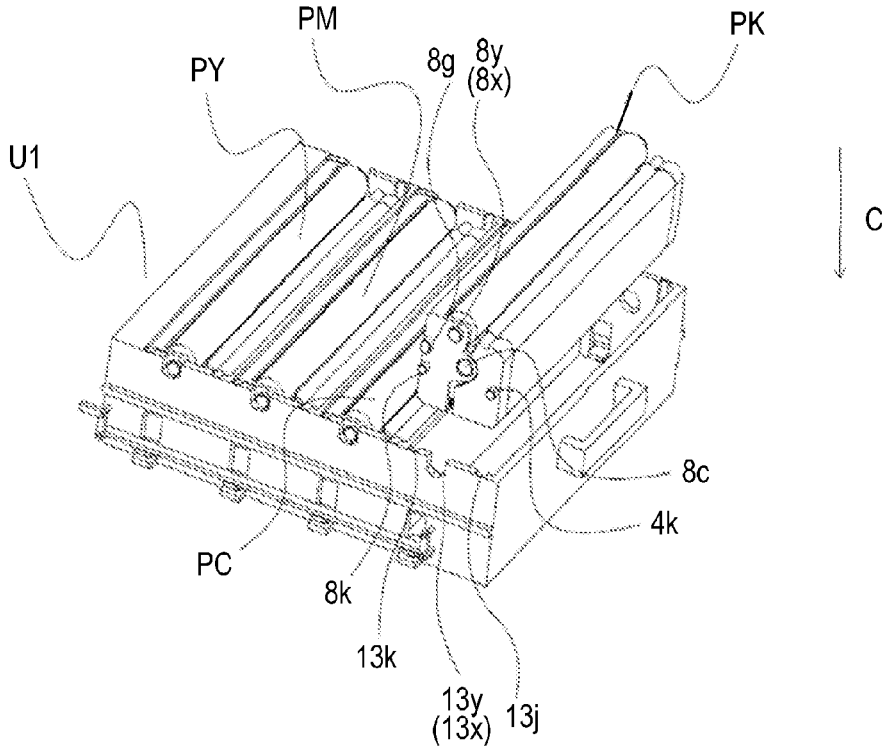
FIG. 9A is a perspective view as viewed from the non-drive side, for illustrating how the cartridge according to the embodiment is mounted into the moving member.
Figure 9B:
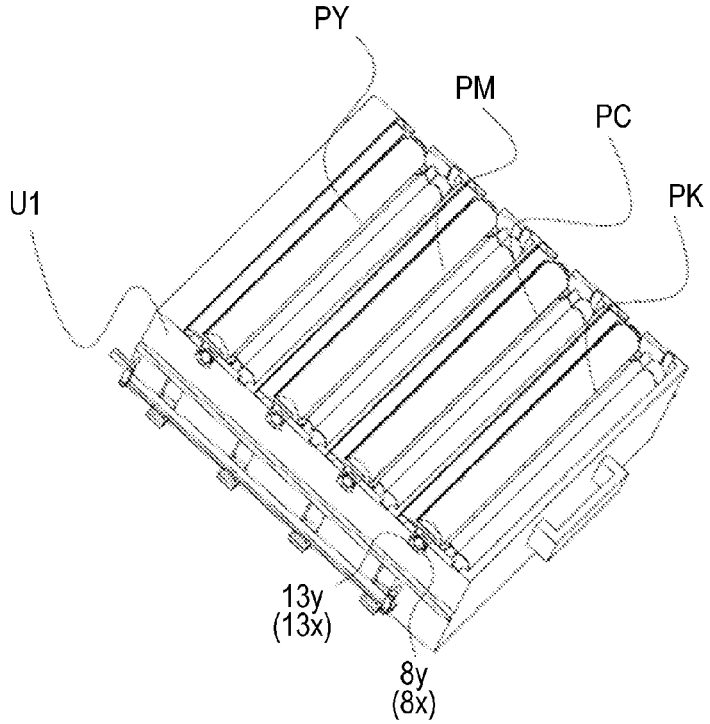
FIG. 9B is a perspective view as viewed from the non-drive side, for illustrating a state in which the cartridge is mounted into the moving member according to the embodiment.

With reference to FIGS. 9A and 9B, how the cartridges P (PY, PM, PC, and PK) are mounted into the moving member 13 will be described. FIG. 9A is a perspective view illustrating how the cartridges according to the embodiment are mounted into the moving member, and FIG. 9B illustrates a state in which all the cartridges are mounted.

The cartridges PY, PM, PC, and PK are mounted respectively into the mounting portions 13*f* formed at four positions in the moving member 13 (refer to FIG. 5A). A user mounts the cartridges P in the direction of the arrow C substantially corresponding to the gravity direction.

In order to mount the cartridge P, the user first mounts the regulated portions 8*j*, 4*j*, 8*k*, and 4*k* arranged at both end portions of the cartridge P along the guiding portions 13*i*, 13*h*, 13*k*, and 13*j* of the moving member 13. Next, the user mounts the rotation regulated portions 8*f* and 8*g* along the guiding portions 13*i* and 13*k*. In this way, the cartridge P is guided along the guiding portions 13*h*, 13*i*, 13*j*, and 13*k*, and the holding portions (temporarily positioning portions) 13*x* and 13*y* abut against the positioned portions 8*x* and 8*y*. Then, mounting of the cartridge P is completed.

(Mounting of Moving Member Unit into Main Body)

Figure 10:
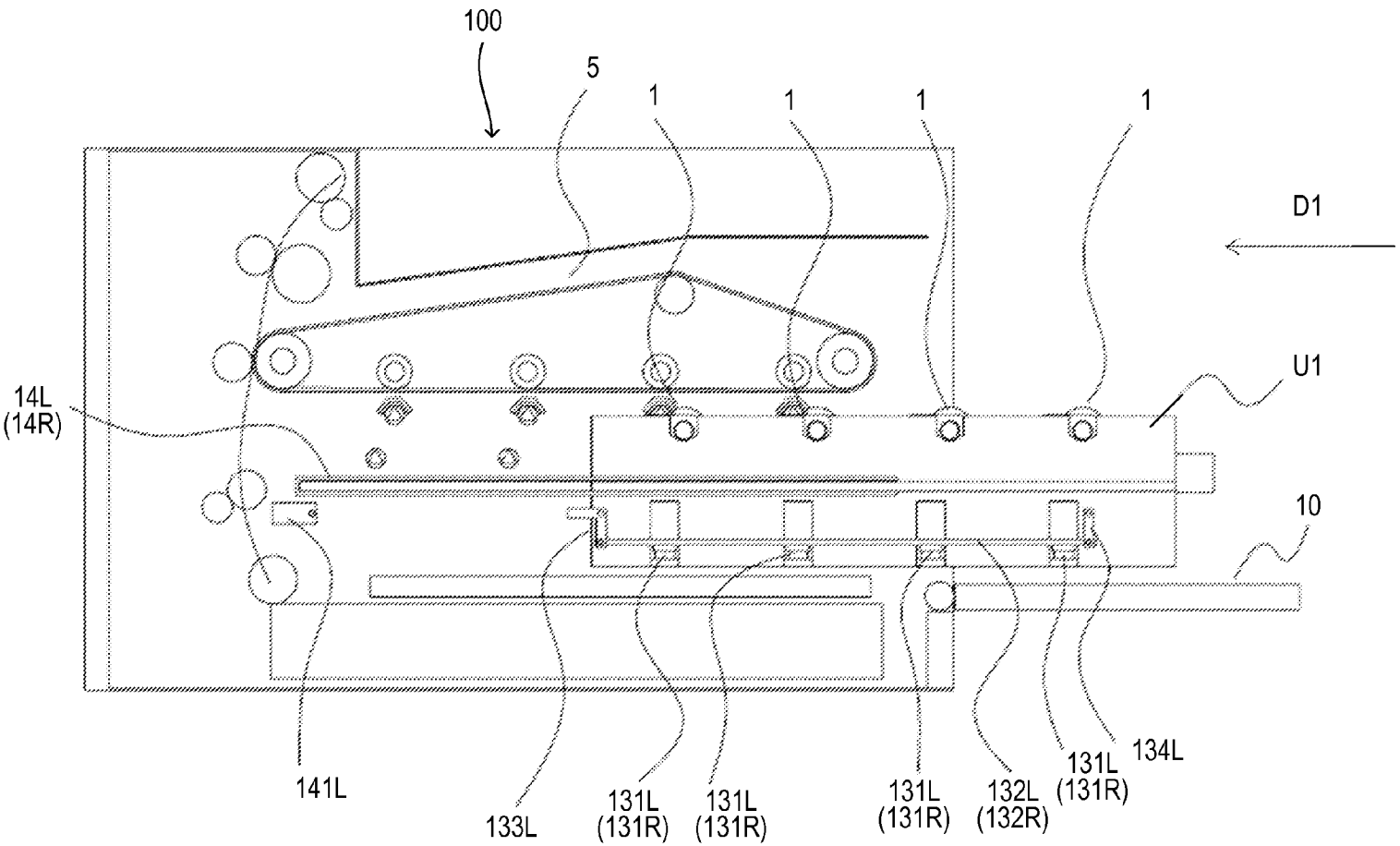
FIG. 10 is a sectional view illustrating how the moving member according to the embodiment is mounted into the main body.
Figure 11:
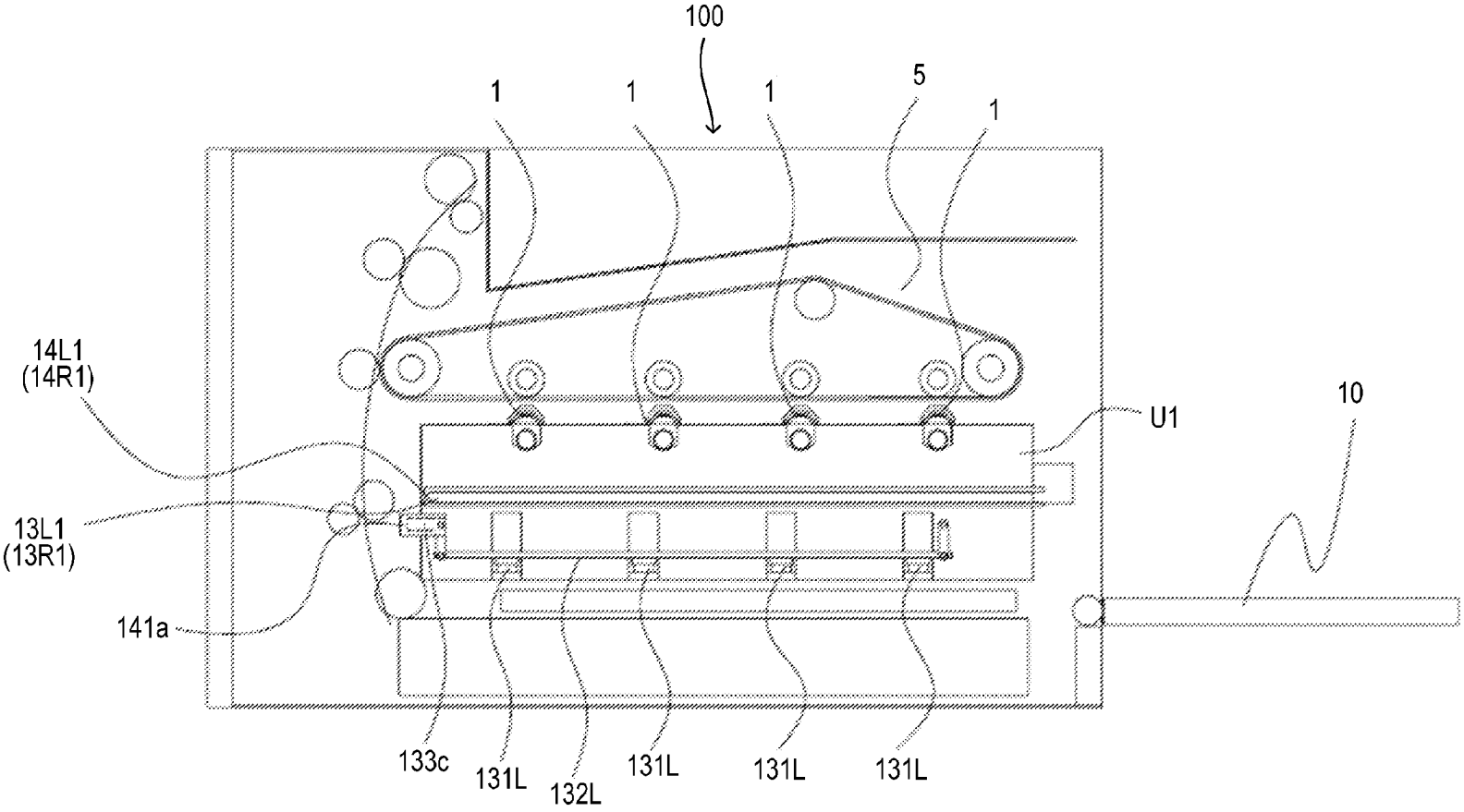
FIG. 11 is a sectional view illustrating a state in which the moving member according to the embodiment is mounted into the main body.
Figure 12:
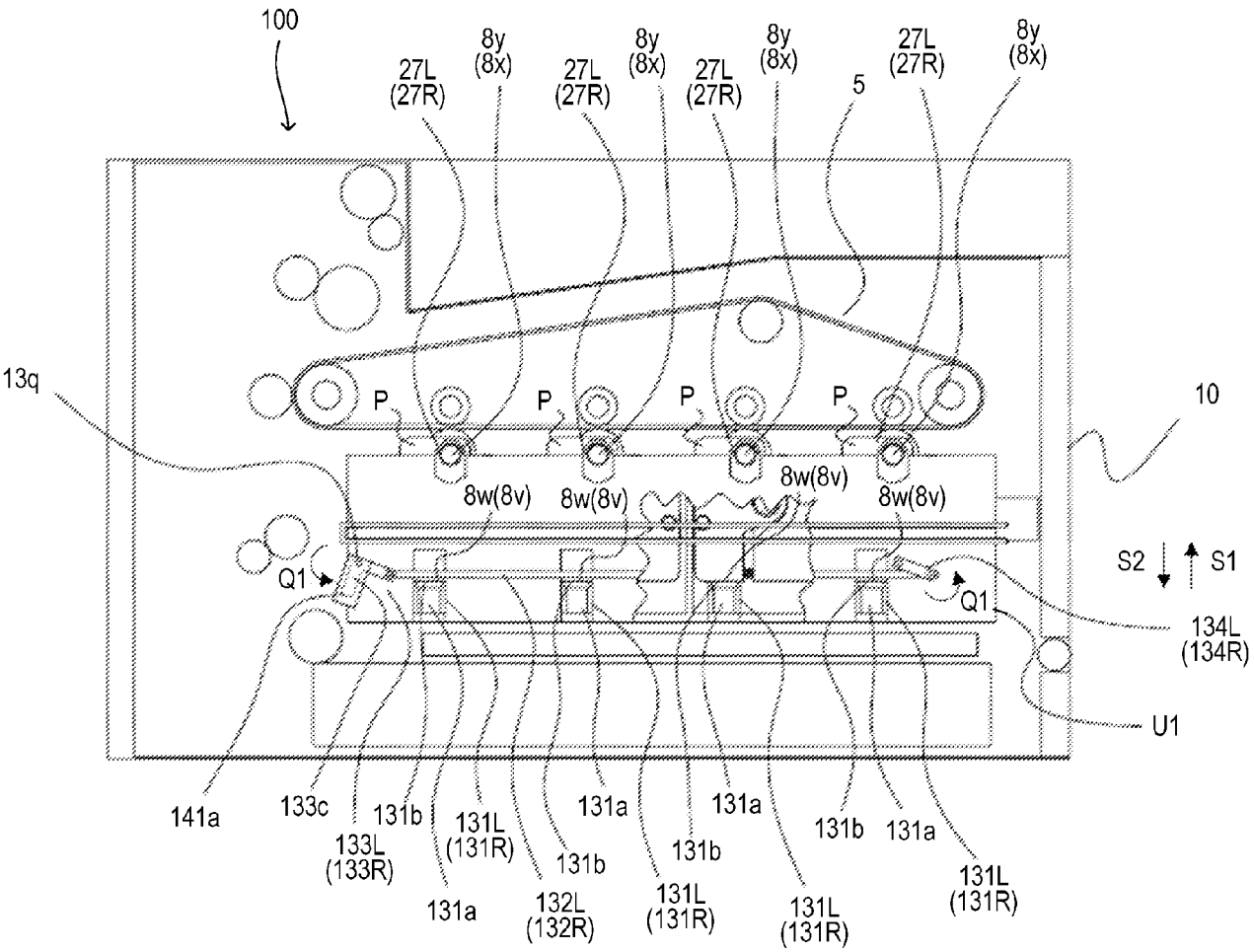
FIG. 12 is a sectional view illustrating a state at the time of image formation according to the embodiment.

With reference to FIGS. 10 to 12, operations of mounting and removing the moving member unit U1 into and from the main body will be described. FIG. 10 is a sectional view illustrating how the moving member unit U1 according to the embodiment is mounted into the main body. FIG. 11 is a sectional view illustrating a state in which mounting of the moving member unit U1 into the main body is completed. Further, FIG. 12 is a sectional view illustrating the state in which the mounting of the moving member unit U1 into the main body is completed to prepare for image formation. The configuration on the drive side (R), which is not described below, is the same as that on the non-drive side (L).

As illustrated in FIG. 10, the moving member unit U1 is mounted along the guiding portion 14L in the direction of the arrow D1. At this time, the regulating member 132L is located at the second position, and hence the biasing forces of the biasing members 131L are regulated by the regulating member 132L as described above. Thus, the photosensitive drums 1 are inserted into the main body while being located at positions retreated from the primary transfer rollers 12 as the transferring members. Therefore, at the time of operating the moving member unit U1, the surfaces of the photosensitive drum 1 and the intermediate transfer belt 5 do not rub against each other.

Then, as illustrated in FIG. 11, when a guided portion end 13L1 of the moving member unit U1 is inserted up to a mounting completion position of a guiding portion end 14L1 in the main body, the switching portion 133*c* in the horizontal direction (moving direction) is engaged with the mating cam portion 141*a*. In this state, the biasing forces of the biasing members 131L are maintained regulated by the regulating member 132L.

Then, in this state, when the door 10 is closed as illustrated in FIG. 12, in conjunction therewith, the switching member 141L arranged in the main body is turned in a direction of the arrow Q1. At this time, the mating cam portion 141*a* of each of the switching members 141 (FIG. 4C) arranged in the main body, and the switching portion 133*c* arranged on the moving member 13 (FIG. 6A) are engaged with each other.

Thus, the first cam member 133L and the second cam member 134L that are arranged on the moving member 13 are also turned in the direction of the arrow Q1 about the rotary shafts (support shafts) 13*q* of the moving member 13. With this, the regulating member 132L arranged on the moving member 13 is moved in the direction of the arrow S1. In other words, the regulating member 132L is moved to the first position, and the regulation performed by the regulating member 132L onto the biasing forces of the biasing members 131L is released.

Thus, the forces of the elastic portions 131*c* cause the pressing portions 131*b* (FIG. 6A) to each press the pressed portion 8*w* (pressed portion 8*v* on the drive side) of the cartridge P illustrated in FIG. 8C. With this, the cartridges P are moved in the direction of the arrow S1. When the cartridges P are moved in the direction of the arrow S1, the positioned portions 8*y* (positioned portions 8*x* on the drive side) of the cartridge P illustrated in FIG. 8C abut against the positioning portions 27L in the main body (FIG. 3B). With this, the photosensitive drums 1 and the intermediate transfer belt 5 are held in abutment against each other, and image formation can be performed. Note that, an operation of removing the moving member unit U1 from the main body is reverse to the insertion operation.

(Advantage of embodiments)

As described above, in the image forming apparatus 100 according to the embodiment, the cartridges P can be pressed directly by the biasing members 131 arranged on the moving member 13 without receiving forces from the main body. Thus, the photosensitive drums 1 of the cartridges P can be stably positioned with respect to the primary transfer rollers 12.

Further, the regulating members 132 are arranged on the moving member 13. With this, at the time when the moving member 13 having the cartridges P mounted thereinto is inserted into the main body, the biasing forces of the biasing members 131 are regulated by the regulating members 132. As a result, a large mounting load can be reduced, and mountability can be improved.

Still further, when the biasing forces of the biasing members 131 are regulated by the regulating members 132, the photosensitive drums 1 are located at the positions retreated from the intermediate transfer belt (transfer member) 5. With this, at the time when the moving member 13 having the cartridges P mounted thereinto is inserted into the main body, the surface of each of the photosensitive drums 1 and the intermediate transfer belt 5 can be prevented from rubbing against each other.

Figure 13:
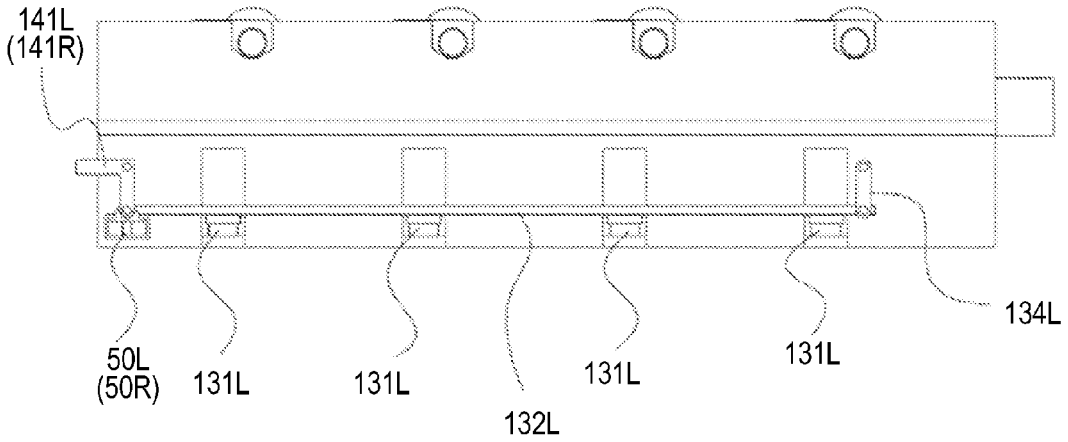
FIG. 13 is a sectional view illustrating a shape of a lock member according to the embodiment.

Yet further, when lock members are used to fix the regulating members 132 at the second position on the outside of the main body, the large mounting load can be reliably reduced, and the second position can be reliably maintained. Specifically, in the embodiment described above, postures of the regulating member 132R and 132L are not fixed in a case where the moving member 13 is located on the outside of the main body, but can be fixed by arranging lock members 50R and 50L configured to fix the postures as illustrated in FIG. 13.

(Modifications)

The exemplary embodiment of the present invention is described above, but the present invention is not limited to the embodiment and can be modified and changed variously within the scope of the gist thereof.

(First Modification)

In the embodiment described above, when the moving member 13 is located at the outer position on the outside of the main body, the image bearing units and the developing units can be integrally mounted into and removed from the moving member 13 as the cartridges (process cartridges). However, the present invention is not limited thereto. Specifically, this configuration may be applicable also to an image forming apparatus in which those units are not integrated into cartridges, or to an image forming apparatus in which, of the image bearing units and the developing units, only the developing units can be mounted into and removed from the moving member 13 as cartridges.

(Second Modification)

In the embodiment described above, the toner image (developer image) on the photosensitive drum 1 is primarily transferred onto the intermediate transfer belt 5 as the transferred member by the primary transfer roller 12 as the transferring member, and then transferred onto the recording medium (sheet material S) as the transferred material by the secondary transfer roller 29. However, the present invention is not limited thereto, and this configuration may be applicable also to an image forming apparatus of a direct transfer type, in which the toner image (developer image) on the photosensitive drum 1 is transferred directly onto the recording medium (sheet material S) as the transferred material by the primary transfer roller 12 as the transferring member.

(Third Modification)

In the embodiment described above, the switching members 141 arranged in the main body are turned interlocking with the door 10. However, drive motors may be arranged in the main body so that the switching members 141 are turned without interlocking with the door 10.

Lastly, advantages of the embodiment described above can be summarized as follows. In the image forming apparatus according to the embodiment above, the instability of positioning in the main body can be reduced, and the large mounting load to be applied when the moving member is mounted into the main body can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-122262, filed Jun. 13, 2014, which is hereby incorporated by reference herein in its entirety.

What is claimed is:

1. An image forming apparatus, comprising:

a moving member configured to be moved with respect to a main body of the image forming apparatus in a state in which the moving member supports an image bearing member and a developer bearing member, the moving member being configured to move between an inner position in which the moving member is located inside the main body and an outer position in which the moving member is located outside the main body so that the developer bearing member is removable from the moving member;

a transfer device provided in the main body so as to be opposed to the image bearing member when the moving member is located in the inner position, the transfer device being configured to transfer a developer image formed on the image bearing member;

a biasing member provided on the moving member, the biasing member including an elastic portion and being configured to bias the image bearing member toward the transfer device in a state in which the moving member is located in the inner position; and a regulating member provided on the moving member and configured to regulate a biasing force of the biasing member by compressing the elastic portion.

2. An image forming apparatus according to claim 1, wherein the transfer device is provided above the image bearing member in a vertical direction, and wherein the biasing member biases the image bearing member toward the transfer device by raising the image bearing member from the moving member when the moving member is located in the inner position.

3. An image forming apparatus according to claim 1, wherein a state of regulation performed by the regulating member is maintained when the moving member is moved from the outer position to the inner position.

4. An image forming apparatus according to claim 1, further comprising a drive mechanism provided in the main body and configured to change the state of the regulation performed by the regulating member into a state of releasing the regulation in the inner position.

5. An image forming apparatus according to claim 4, further comprising a cam member provided on the moving member and engageable with the drive mechanism.

6. An image forming apparatus according to claim 4, further comprising a door provided on the main body and configured to open and close an opening portion through which the moving member is moved, wherein the drive mechanism interlocks with opening and closing of the door, and wherein the regulation is released when the door is closed.

7. An image forming apparatus according to claim 3, further comprising a lock member provided on the moving member and configured to maintain the state of the regulation.

8. An image forming apparatus according to claim 1, wherein the regulating member and the biasing member are provided on each of both side end portions of the moving member in a direction intersecting with a moving direction of the moving member.

9. An image forming apparatus according to claim 1, wherein the regulating member is formed into a strip shape elongated in a moving direction of the moving member.

10. An image forming apparatus according to claim 9, wherein the biasing member comprises:

a region which is located on a side opposite to the moving member with respect to the regulating member and faces the regulating member; and a region which does not face the regulating member.

11. An image forming apparatus according to claim 1, wherein, when the moving member is located in the outer position, the image bearing member and the developer bearing member are integrally and removably mountable to the moving member as a cartridge.

12. An image forming apparatus according to claim 1, wherein, when the moving member is located in the outer position, of the image bearing member and the developer bearing member, only the developer bearing member is removably mountable to the moving member as a cartridge.

13. An image forming apparatus according to claim 1, wherein the moving member is provided with a plurality of image bearing members, and wherein a plurality of biasing members are provided correspondingly to the plurality of image bearing members, respectively.

14. An image forming apparatus according to claim 1, wherein the transfer device comprises a transfer roller, and wherein the biasing member biases the image bearing member toward the transfer roller.

15. An image forming apparatus according to claim 1, wherein the transfer device comprises an intermediate transfer belt onto which the developer image is transferred, and wherein the biasing member biases the image bearing member toward the intermediate transfer belt.

16. An image forming apparatus according to claim 1, wherein the transfer device transfers the developer image from the image bearing member onto a recording medium.

* * * * *